US009543051B2

(12) United States Patent
Lehmann

(10) Patent No.: US 9,543,051 B2
(45) Date of Patent: Jan. 10, 2017

(54) SYSTEM AND METHOD TO CONTROL MIGRATION OF CONTAMINATES WITHIN A WATER TABLE

(71) Applicant: Harry V. Lehmann, Novato, CA (US)

(72) Inventor: Harry V. Lehmann, Novato, CA (US)

(73) Assignee: Green Swan, Inc., Novato, CA (US)

( * ) Notice: Subject to any disclaimer, the term of this patent is extended or adjusted under 35 U.S.C. 154(b) by 0 days.

(21) Appl. No.: 14/476,591

(22) Filed: Sep. 3, 2014

(65) Prior Publication Data

US 2015/0065775 A1 Mar. 5, 2015

Related U.S. Application Data

(60) Provisional application No. 61/873,143, filed on Sep. 3, 2013.

(51) Int. Cl.

| | |
|---|---|
| ***G21F 9/16*** | (2006.01) |
| ***G21F 9/04*** | (2006.01) |
| ***G21F 9/06*** | (2006.01) |

(52) U.S. Cl.

CPC . *G21F 9/04* (2013.01); *G21F 9/06* (2013.01); *G21F 9/16* (2013.01)

(58) Field of Classification Search

CPC ..... E02D 3/115; E02D 19/14; E21B 36/001; G21F 9/04; G21F 9/06; G21F 9/16

See application file for complete search history.

(56) References Cited

U.S. PATENT DOCUMENTS

| | | | | |
|---|---|---|---|---|
| 4,860,544 | A * | 8/1989 | Krieg et al. | 62/45.1 |
| 4,974,425 | A * | 12/1990 | Krieg et al. | 62/45.1 |
| 5,050,386 | A | 9/1991 | Krieg et al. | |
| 5,507,149 | A * | 4/1996 | Dash et al. | 62/531 |
| 5,730,550 | A * | 3/1998 | Andersland et al. | 405/128.6 |
| 7,435,037 | B2 * | 10/2008 | McKinzie, II | 405/130 |
| 2004/0120771 | A1 * | 6/2004 | Vinegar et al. | 405/128.4 |
| 2004/0120772 | A1 | 6/2004 | Vinegar et al. | |
| 2012/0310029 | A1 | 12/2012 | Lehmann | |

FOREIGN PATENT DOCUMENTS

| | | | |
|---|---|---|---|
| DE | 3410132 | A1 | 10/1985 |

* cited by examiner

*Primary Examiner* — Tara M. Pinnock
(74) *Attorney, Agent, or Firm* — Duane Morris LLP

(57) ABSTRACT

System and Method is described that controls the release of contaminated water by rapidly freezing the ground water, including salt water, which permeates the area underneath the a contamination source, so that the resulting ice lens mitigates the extent to which radioactive water is released into the environment. An aperture in the containment area allows the dispersal and dilution of the contaminates by allowing in ground water from outside, and/or removing water from the containment area. The variable aperture may be a physical valve or preferably an opening in the ice shield which size may be controlled by freezing or thawing portions of the ice shield.

2 Claims, 9 Drawing Sheets

SYSTEM AND METHOD TO CONTROL MIGRATION OF CONTAMINATES WITHIN A WATER TABLE

CROSS REFERENCES

This non-provisional application claims priority benefit of Provisional application No. 61/873,143 filed Sep. 3, 2013 entitled "Use of Intermediate Fluids as to the Mechanisms in the system & Method to Mitigate Migration of Contaminates" the entirety of which is hereby incorporated by reference.

BACKGROUND

On Mar. 11, 2011, the Fukushima nuclear reactor site in Japan was severely crippled, with major radiation leakage, as a consequence of a massive earthquake at Tsunami which struck Japan.

On Apr. 5, 2011, within one month after the onset of the Fukushima disaster, the undersigned Harry V. Lehmann, caused to be filed a Provisional Patent Application, being No. 61/471,967, which set forth the invention upon which US Non-Provisional Patent Application US 2012/0310029, as published on Dec. 12, 2012. The undersigned works as the CEO of Green Swan Inc. (www.greenswan.org), a California-based firm concerned with human health in relation to radiation.

The above filings, on Apr. 5, 2011, and the later US Non-Provisional Patent Application filed on Apr. 5, 2012, contemplate the use of super-cooled fluids circulated in the Figures which are integrated into both filings, particularly as illustrated in FIG. 1 of US 2012/0310029. The super-cooled fluids as discussed hi the above Provisional and Non-Provisional filings while specifically mentioning the use of fluids other than N2, contemplated the use of extreme low boiling point fluids, so that extreme cold could be brought to bear immediately below the crippled reactor site, and similar sites, including that further removal of heat (and consequent increased rapidity of "ice-basket" riming) would result from an increased rate of boil off of the submitted fluids, due to increased pipe aperture at the mid-points of the doubled barreled shallow ice basket, or shallow ice bowl, approach contemplated in those patents applications.

Prior to the above filings, previous experimental and very limited practical deployment had been made of Liquid Nitrogen for the purposes of ground stabilization, most famously, circa 1995, in regard to the drilling and N2 filling of 178 holes around the Leaning Tower of Pisa so that the Tower could be stabilized in place without tipping over while restoration work was undertaken.

Prior to the above filings, previous experimental and very limited practical deployment had been made of other super-cooled fluids for the establishment of an "ice wall" barrier: Prior purposes of such "ice wall" approaches have included the establishment of a vertical ice wall surround to protect against radioactive ground water migration at a contaminated nuclear site in the United States, and a similar use of a deployed vertical ice wall surround was made, but not activated, for containment of water away from an active gold mine in Canada, and, also prior to the above patent application filings by the undersigned in April of 2011 and April of 2012, there were other attempts made to stabilize ground, or to mitigate ground water migration, through the use of vertical ice walls.

All of the prior Art, meaning all known Art in existence prior to the above filings in April of 2011 and April of 2012 was based upon the drilling of vertical holes, and the filling of those holes with super-cooled solutions, or the circulation of super-cooled solutions within such vertical holes, typically to obtain containment of ground water migration by the drilling of and filling of such super-cooled holes down to an impermeable or less-permeable sub-strata, including strata of harder clay or bedrock. In practical effect, all known prior attempts in this area had been to create a containment tank, with a surface circumference defined by the ring of drilled and super-cooled vertical hole, and a bottom circumference defined by the bottoms of such holes, hoped to be at points interfacing with the expected less-permeable sub-strata constituting the bottom of the large ice walled holding tank defined by the so-drilled and so-cooled holes, often in recent iterations contemplated to be taken to and maintained at a super-cooled state by the circulation of super-cooled saline solution.

The disclosed subject matter is directed to a System and Method for retarding and controlling the speed of flow of contaminated water, from a nuclear reactor or other contamination source from which such contaminated water is issuing.

The subject matter advantageously uses micro-tunneling, coupled with pipe insertion, coupled with insulated pipe insertion, so that liquids with very low boil points, such as Liquid Nitrogen, or other refrigerant gasses, may be inserted in the liquid state, to vaporize upon release from the insulated containment, so that heat energy is absorbed from the water table, resulting in a reduction in flow rate, thereby impeding the capacity of the water under flow to carry particulate matter.

The subject matter also discloses a "laced" approach, in which twin barreled pipes, as herein set forth, may be inserted an non-conflicting depths, but in such proximity to mutually contribute to water sludge accumulation, ice rime, and, with sufficient evaporation process, the formation of an ice lens, sufficient to retard the escape of contaminated water.

The effect of this System and Method is to control and slow the release of contaminated water as it is possible to rapidly obtain the freezing the ground water, including salt water, which permeates the area underneath the melted reactors, so that the resulting ice lens will mitigate the extent to which radioactive water is released into the environment. The method here described may be used for this purpose through the accomplishment of two goals; first, a resulting reduction in the quantum of radioactive water released, per se, and secondly, a reduction in the level of particulate radiation reaching the environment due to slowed water flow velocities.

It is advantageous to appreciate the existence of "trenchless excavation" for pipe installation. "Direct Jacking," and the "Micro-tunneling" are approaches widely deployed in the civil engineering context, and similar approaches are used for waste water treatment pipe installation.

Direct Jacking is a tunneling process whereby a single new pipe is installed in one pass. A bore head begins the tunnel excavation from an access shaft and is pushed along by hydraulic jacks that remain in the shaft. The link to the boring head is maintained by adding jacking pipe between the jacks and the head. By this procedure, the pipe is laid as the tunnel is bored.

Micro-tunneling is defined as a trenchless construction method for installing pipelines. The North American definition of microtunneling describes a method and does not impose size limitations on such method; therefore, a tunnel may be considered a microtunnel if all of the following features apply to construction:

Remote Controlled: The microtunneling boring machine (MTBM) is operated from a control panel, normally located on the surface. The system simultaneously installs pipe as spoil is excavated and removed. Personnel entry is not required for routine operations.

Guided: The guidance system usually references a laser beam projected onto a target in the MTBM, capable of installing gravity sewers or other types of pipelines to the required tolerances, for line and grade.

Pipe Jacked: The pipeline is constructed by consecutively pushing pipes and the MTBM through the ground using a jacking system for thrust.

Continuously supported: Continuous pressure is provided to the face of the excavation to balance groundwater and earth pressures.

The above citations are inserted merely to acquaint the reader with the fact that in the modem context it is possible to obtain rapid remote controlled boring of pipe holes, so as to facilitate installation of pipe suitable for such installation. The remainder of the "ice lens" approach as herein stated are based upon the availability of such boring technology.

No sophisticated explanation of the Rankine Cycle is attempted nor necessary here, but a baseline discussion will speed appreciation for those who have not seen their high school or college texts for a while.

It is understood that it takes energy to convert any type of matter from its liquid state to its vapor state. Rather than getting esoteric, just consider the tea kettle; the kettle and its contents are heated, the boiling point is reached, at the boiling point the water reaches its vapor state, and leaves the kettle. It almost immediately precipitates to what we see as "steam," although close examination of the spout will show a gap, perhaps we could call it a vapor gap, which is a view through the transparent water in its true vapor state. That water in the vapor state is invisible is known to those who have visited the engine rooms of steam turbine aircraft carriers, where in olden days, when a leak was suspected, a broomstick would be swung before a worker as he walked, as the thin vapor stream would cut the stick in half, thereby saving the man. Those turbines, of course, took immense amounts of fuel to operate, originally fuel oil, later nuclear. Bottom line, to take a fluid to the vapor state requires heat.

Our common experience may cause us to first visualize this as a one-way street of analysis; we apply heat, the fluid eventually reaches the boiling point as a result of the input of the heat, the heat having forced sufficient molecular vibratory activity that the vapor state is reached as a result of the heat. However, as Lord Kelvin taught, the system is a two-way thoroughfare. That is why we have working refrigerators. In that context, the evaporation cycle of a gas, chosen for its low boiling point (an issue which will be shown as relevant to the macro-machine here contemplated for radioactive containment) can, through compression of that gas (thus the "compressor" of a refrigerator) result in the use of the evaporative cycle, which is called the Rankine Cycle, for the extraction of heat, through the forcing of the cycle by compression of the vapor (gaseous state) so that the liquid state is reached, and then the carefully controlled evaporation of the subject liquid, thereby drawing heat at that point of conversion, from the surrounding material world. These are well understood baseline concepts with which all readers of this paper will have been familiar, but it is suggested that a quick review will enhance appreciation of the feasibility of the macro-application as hereafter explained.

The super-cooling of the circulated saline solution or other super-cooled liquid so-placed or so-circulated in such holes used an intermediary fluid to cool the affected earth, with the actual cooling obtained by Rankine Cycle cooling, yet without direct contact between the super-low boiling point fluids lined holes used to create the vertical ice wall which has been the aim of all known work prior to the filing of the Lehmann patent applications of April 2011 and April 2012.

It is advantageous to integrate the use of intermediary cooling fluids, including saline solutions, into the "ice basket" approach first articulated by the Lehmann.

In the last week prior to the filing of the Provisional Patent Application of Sep. 3, 2013, widely circulated news reports have indicated that those charged with responsibility for the attempted remediation of the natural disaster-caused nuclear contamination events at Fukushima are now seeking to adopt and deploy the older, ice wall" technologies previously used or experimented with in the United States and elsewhere as a means of ground water migration mitigation at toxic sites.

The prior "nice basket" filings of Lehmann, as incorporated herein by reference because of the creation of a shallow ice bowl for containment purposes, present clear energy consumption and speed of-construction advantages over the older "vertical ice wall surround 11 approach currently under discussion for remediation of the disaster at Fukushima.

The disclosed subject matter further explains the very considerable energy consumption and speed-of-construction advantages of the previously filed Lehmann patents, and for the additional purpose of asserting Claims for the use of intermediary cooling fluids, such as saline solutions, as part of the "shallow ice basket, or "shallow bowl" approach contemplate in the April 2011 and April 2012 patent filings. The prior art did not contemplate the use of computer controlled horizontal and mixed angle drilling, whereas such modem computer controlled mixed angle drilling was an inherent feature in the prior Provisional and Non-Provisional patent filings which have above been incorporated by reference into this document.

As to Fukushima, and in terms of application to any similar ground water migration mitigation system, the current, unexecuted, "ice wall" approach involves the establishment of a very deep ice walled cylinder, which would wall in the contaminated water with ice and frozen soil, such that the fence would run all the way down to bedrock or clay (far more than a hundred feet) at which point it is believed that the contaminants would hopefully be stopped from further ground water migration due to the "impermeable clay later" which is stated as residing at that subterranean level. This approach in comparison to the "ice basket" outlined in the previously filed Lehmann patent filings, results in a vastly larger volume of contaminated water containment, resulting in a vastly greater use of energy for cooling, than will occur of the "ice basket" approach outlined in the prior Lehmann filings is chosen instead. The presently contemplated "ice wall" approaches, using vertical shafts, does not make use of modem computer controlled horizontal and mixed" angle drilling technique, and the result of this is that a vastly larger pool of contaminated water is contained by the "ice wall" system than is the case if the more shallow "ice basket" or "ice bowl" as contemplated in the prior Lehmann patent filings is deployed.

The value of the "shallow bowl of ice" approach is very quickly and clearly illustrated with simple kitchen tools. The experimenter seeking to verify the advantages of the "shallow ice bowl" approach needs only one large cooking pot and one salad bowl having a diameter larger than the diameter of the pot.

By taking the large bowl, one with a diameter at the top larger than the diameter of the cooking pot, and placing the bowl the big metal pot, the experimenter will see demonstrated that only the bottom sixth or so of the salad bowl volumetrically, intrudes within the cylinder of volume described by the interior dimension of the large pot. In fact, due to the curvatures of the line of the bowl from a starting position at the "ground level" emulated by the top of the pot, the actual volumetric displacement represented by the interior dimension of the bowl, when compared to the volume of the pot, may be considerably less than a sixth of the volume of the pot.

In practical operation, at Fukushima, this results in a several positive advantages over the "ice wall" approach currently under consideration;

A) the evacuation of the contaminated water from a smaller starting volume means that vastly less ground water is contaminated during operation, which means that:

B) Far less groundwater need be pumped out, and further that:

C) Due to decreased interior volume of the pipes used for this purpose, coupled with the smaller volume of contaminated groundwater perpetually evacuated, the energy required for pump operation is very substantially diminished, and:

D) Pump strain is reduced, and:

E) Construction time, due to the use of computer guided micro-tunneling is much less, and:

F) Volume of extracted soils is diminished, and:

G) Immediate production of the ice bowl does not prohibit the construction of the ice fence, using the more traditional ice wall, approaches, such that a failsafe system would automatically evolve, and:

H) The currently announced "ice wall" approach contemplates forty years of accumulation of heavy contaminants at the allegedly impermeable clay layer at the bottom of the cylindrical area hoped to be described by the currently anticipated "ice fence." Eventually, so it is hoped, four or five decades down the road, the site is to have been decontaminated. As a result, it would appear that the need for the ice fence would abate. Even if not the case, an assumption that there will be an ice fence, in site at a coastline, which will somehow remain in perpetuity is optimistic. The contaminants involved by their atomic weight nature heavier than their surrounding milieu, such that the accumulation of a substantial contaminant layer at the bottom of the proposed cylinder is unavoidable the "bottom of the pot," see above). The contaminants generate heat when accumulated, and the character of interaction with the hypothetical clay layer is not known, and: Assuming the very best case with the clay layer (hardening by heat), upon the cessation of the "ice fence" cooling process, the result of the cylindrical "ice fence" is a huge residue of impermissibly dangerous contaminants, residing in perpetuity, and inevitably capable of lateral migration.

In comparison to all of the above disadvantages of a large cylindrical trice wall" the "ice basket" approach as articulated in the previously filed Lehmann patent applications, if deployed, would require the constant handling of only about a sixth of the volume, or perhaps a far smaller fraction, of the amount of contaminated water which would have to be constantly evacuated and treated if the more "classic ice wall" approach is pursued. The use of the "ice basket" approach will result in faster construction, less construction materials, and far less contaminate water to be handled, resulting in a substantial reduction in energy use needed to keep the pumps going, as well as far less equipment strain, and far less necessary storage of contaminated water J this last perhaps being the largest advantage of the previously filed Lehmann approach, per Apr. 5, 2011 and Apr. 5, 2012.

The present subject matter also addresses an unusual situation where there has been contamination into the earth and groundwater beneath a site, but where due to changed circumstances (such as the sinking of ground level from an earthquake, as happened at Fukushima) there are persistent or intermittent situations where hydrostatic pressures are greater beneath a site than at ground level for that site. Fukushima currently stands as an example of this peculiar and difficult situation, where a combination of gravity, great heat and great weight have caused penetration of radioactive materials through concrete containment and into the ground below and groundwater, while simultaneously there may be greater hydrostatic pressure below, such that there is a radioactive artesian effect.

These and many other objects and advantages of the present subject matter will be readily apparent to one skilled in the art to which the invention pertains from a perusal of the claims, the appended drawings, and the following detailed description of preferred embodiments.

DETAILED DESCRIPTION

Figure 1:
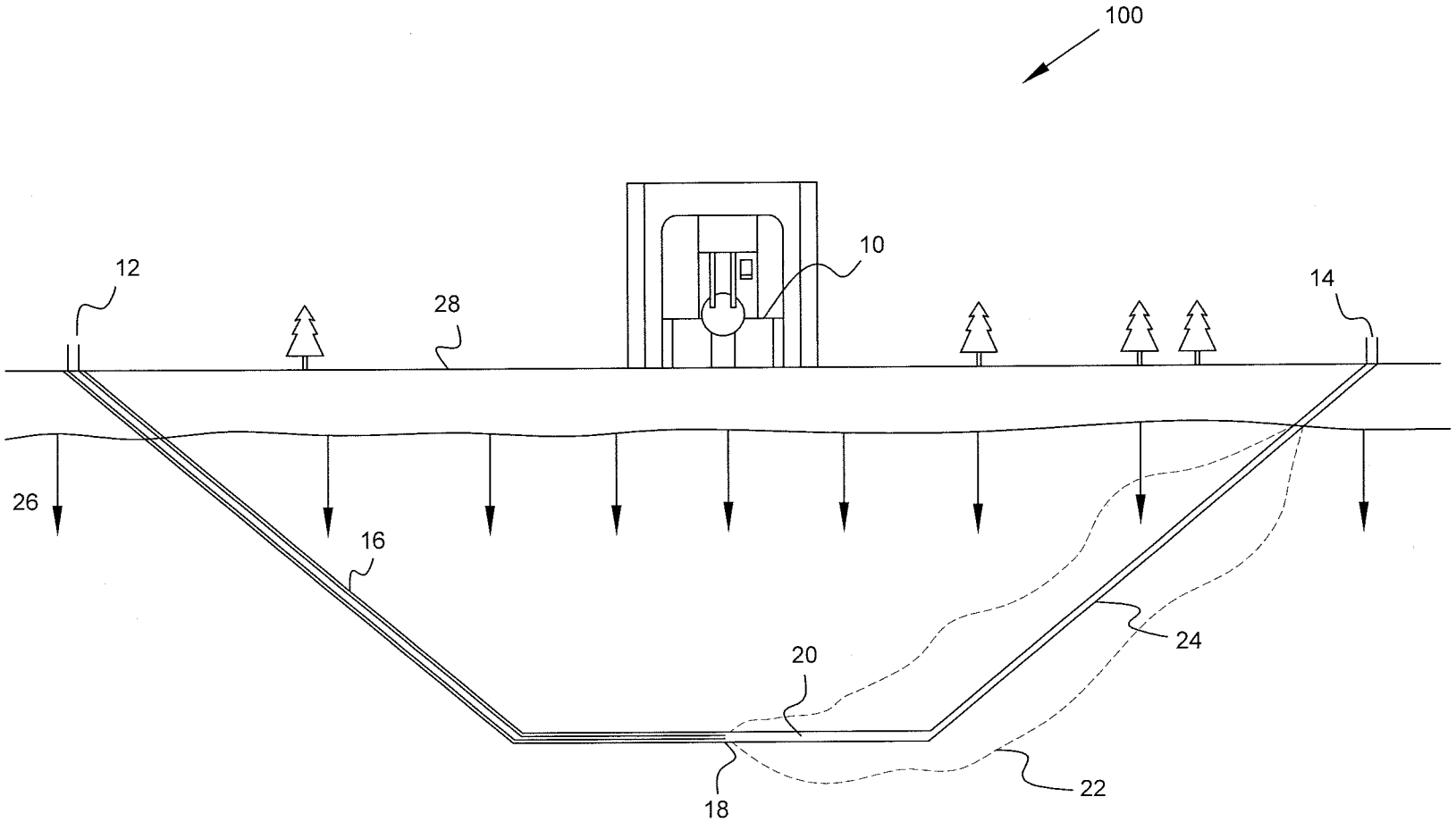
FIG. 1 is a top view of an embodiment of the present subject matter.

It is within existing engineering technology to create what amounts to a macro-refrigerator through very carefully sited drilling of the earth around the reactors suffering from meltdown, so as to create an "ice basket" beneath the reactor cores involved. The formation of such an ice lens, or basket in its fullest application, will result in diminished levels of radioactive water reaching the sea. This is what can be done:

One embodiment to prevent such migration of contaminates is the drilling of a multiple twined lateral tunnels beneath the affected reactors. The tunnels, probably six twin bores, should be drilled, first, down at a 45 or so degree angle (or such shallower angle as may be necessary for pipe insertion), to then a level bore, at a drilled position centered below each melting reactor.

For example to use an arbitrary figure of a thousand foot radius from the center of the containment, may define an appropriate balance between exposure avoidance needs and practical necessities relating to the boring and pipe insertion process. Obviously, commencement of operations from a threshold outside the ambit of severe cumulative exposure risks would be wise, but at the edge, so as to minimize the amount of drilling involved.

Preferably the boring should be a downward drilling on a 45 degree angle, to, again, here for illustration, about one hundred feet below or lower than the base of the reactor, or whatever is left of it as in the case of an accident. The construction of the containment grid could also be done preemptively during construction of the reactor or other source of contaminates, or as a matter of course before any such emergency.

There may be a lateral portion. These lateral portions are well within the capacity fairly commonly available robotic pipe insertion drilling equipment as alluded to above. It is suggested that due to various factors, multiple holes should be commenced as equipment and staffing become available.

It is known that 24 inch micro-tunneling is available in industry. For the instant illustrative purposes, it is envisioned using a 18 inch pipe. There should be the insertion of insulated pipe through the resulting tunnel. It is preferable to keep this as simple as possible. There are means of cooling the frontal area of the insertion sans pumping, but believed this to be a bit more complex than likely justified.

Preferably there should be two twin pipes drilled, think of it as a "double barreled" approach. This is necessary because the currently escaping radioactive sea water is at or near sea level, and not solely at lower elevations, though this will of course inevitably become a deepening problem. The desirability for twin bores will be shortly examined.

Upon the insertion of the insulated pipe, which at the least must have telemetry for heat, there should be the insertion of a low boiling point gas. Preferably liquid nitrogen. It is noted that while venting of the nitrogen post use is likely, this need not involve any particulate radiation. There is the need to control the post evaporation venting of the gas, which can involve compression and reuse, however such is not the focus, the focus here will be on cooling, and not re-circulation.

The baseline is that a cold non-explosive gas, here liquid nitrogen may be inserted via a well-insulated interior casing, or pipe, which is in turn inserted inside the pipe originally inserted into the bore. This method mimics a repair method already in wide use for the repair of deteriorated pipe via the insertion of a pipe of lesser dimension, which in current sewer pipe repair scenarios is called "re-lining."

When spot repairs of old pipe lines, mainly sewers, are no longer viable, local authorities are faced with the problem of rehabilitating or replacing pipelines in the course of time. Replacement has the disadvantage of being very costly and disruptive to urban areas where the largest sewer networks are located.

HOBAS pipes are inserted in the existing pipeline with grout cementing them in place. In view of the savings municipal authorities are now allocating as much as 50% of budgets to rehabilitation. These types of products are ideal for this application being lightweight, corrosion resistant, quality-assured, easily jointed and rigid to resist grouting forces.

It is noted that there are several indications at the HOBAS site of the use of resins to obtain near-perfect interior smoothness, coupled with entire leakage prevention, using modem materials. So long as the bore can be made at a level sufficient that heat ruin of the piping systems here contemplated is avoided (this may ultimately involve "leapfrog" installations of the "pipe basket"), there may and should be the capacity to entirely insulate the low boiling point gas (here, nitrogen) from contact with radioactive fluid. This would result in a clean vent, although the potential for compression and re-circulation (a true "mega-fridge") is obvious.

In this contemplated system of twin, or paired, bores, each twin bore will have a "nominal" end (where temperatures exterior to the insulation are consistent with ambient OAT), and a "cold end" which will be the area from the point of release just to the near side of bottom dead center from the reactor. It is preferable that the point of N2 release be prior to the position in the pipe directly below bottom dead center of the reactor, so that direct cooling from the N2 can come prior to, or without, pipe insertion directly below the heat source. The reasons for this will be fairly apparent thus no fuller explanation is furthered here.

Thus, half the each pipe is "ambient," and half of each pipe, from bottom dead center to the exterior gas release (or compression) point, is very cold. This will cause ice to rime upon the pipe, and so long as gas release is continued, cooling of the surrounding rock/water substrate to occur, to the extent that ice will migrate out from the pipe. This is why a twin bore is advantageous, since the result will be cooling all the way from bottom dead center to the surface, with the insulated pipe having been installed from opposing positions on the circle which defines the drill origination circumference around the affected reactor(s). One such installation, of just one twin pipe system, would, if well engineered, result in some reduction of rate of radioactive water loss to the environment, due to water viscosity increase and resulting reduction in velocity of migration. Thus, a resulting "ice lens" beneath the affected reactor.

However, the next set of twin pipe bores, each "fueled" in opposing directions of super-cool liquid insertion, would commence the formation not just of an "Ice Lens" but rather the building up of an ice web, or "Ice Basket" should result. It would be essential to drill each succeeding twin bore system to an elevation above or below all preceding bores, so as to avoid one drilled system from ruining its predecessor. These are matters of intricate field detail, but quite manageable for one of skill in the art.

There are two methods of freezing involved. First, the liquid nitrogen (the world's supply could if necessary be devoted to this, a unifying effort, though I recognize that this as a melodramatic statement) will, at the least, if there is continuation, cause a freezing of the ground water, just because it is a super-cold liquid. However, it will inevitably evaporate, also thus causing "heat drain" from the Rankine process from the surrounding rock/water milieu. If this groundwater freezing is thus brought to equilibrium with the heat output, time will be bought. There are other applications, but there are problems with loss of ductility at every turn. Still, a desperate situation may sometimes only be surmounted through recognition of the need for an inventive approach. As with some other suggestions, this is sent along for reasons of citizenship. Rather than evaluating this, it is suggested that it be forwarded and evaluated by others more formally qualified than the undersigned.

Figure 2:
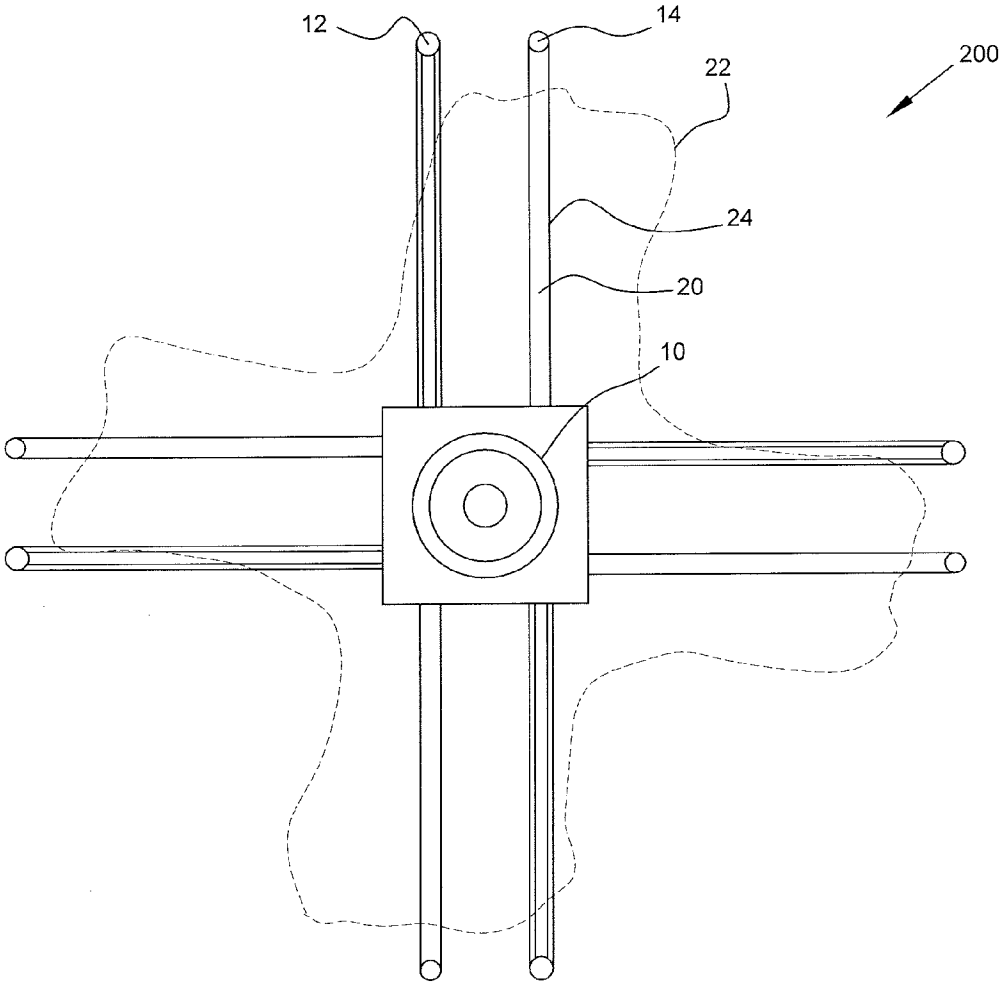
FIG. 2 is a side view of an embodiment of the present subject matter.

FIGS. 1 and 2 illustrate the proposed drilling, and the results of actuation of the system as herein described. This is a method through which the leakage of radioactive water into the ocean can be reduced in magnitude and stalled at such a reduced rate for a protracted period of time.

FIG. 1 is a side view of an embodiment 100 showing a simple drawing of a nuclear reactor 10 of a general type, the earth 28 upon which it is situated, the water table 26, an inlet casing pipe 12, through which an ultra-low boil point fluid is inserted within an insulated pipe 16, so that, at aperture 18, vaporization of the gas 20 occurs. This results in contact cooling of the soil proximate the cooling channels 24, from the N2, or other chosen refrigerant itself, but also draws heat, from the evaporative cooling process inherent in the involved vaporization. An ice region 22 is thereby produced at the exterior of the casing. Care must be taken to assure that the N2 or other suitable gas is utterly dry, to avoid aperture contamination. Hydraulic process is noted as one possible adjunct to insertion. As noted previously the channels may be formed during the construction of the site and thus other techniques may be available. The potential for capture at vent 14 is recognized, with possible re-compression and delivery of the compressed liquid and gas to the inlet 12 as discussed above. However release to the atmosphere is acceptable if tight seam is obtained, infiltration of the contaminate is avoided, in which case the N2 in the gaseous state would have no toxic character, already being roughly 78% of the ambient air.

FIG. 2 is a top view of an embodiment 200 of the subject matter illustrating the use of multiple non-intersecting pipes, separated by differing but near depth levels, so that, post aperture 18, as to each such pipe, there is cooling effect from the direct contact with the super-cooled liquid form of the N2 (or other) involved, and to a greater effect, continuing up pipe 24 (and in this instance downstream) the vaporization draws heat into the N2, which is then exhausted 14. This results in cooling of the surrounding water, the viscosity increase resulting therefrom thereby slowing velocity, and thereby reducing capacity for the carrying of particulate matter. In addition, with precise modeling before the fact and precise calibration in execution, the overlapping instances of evaporating cooling will cause an ice lens 22 formation below the reactor 10, which should migrate upwards in accordance with the exhaust pipes and their associated cooling effect. A partial ice lens 22 is shown in FIG. 2. It is noted that while these drawings have tended to illustrate the placing of the aperture near bottom dead center, it likely will work better towards ice lens formation if the aperture point is directly below the first encountered edge from the vantage point of the insulated pipe, so that there will be a resulting four cold pipe confluence below the partial melt, so as to assist in ice web propagation. To assist in evaporation, a vacuum may also be created in the cooling channels. Temperature control would be advantageous.

Multiple configurations of the cooling channels are envisioned in defining the boundary of the containment area, such shapes may include bowl shapes, saucer shapes, hyperbolic, parabolic, cylindrical or rectangular shape.

Another aspect of the present subject matter is the uses of throttling of the gas rather than evaporation. In such case a compressed gas would be provided and then expanded through the aperture 18 into the cooling channels 24 at a much lower pressure and temperature.

Still another aspect of the disclosed subject matter is the use of computer controlled drilling to accomplish both a mouth-up ice bowl beneath the contaminated site and directly beneath it a mouth-down bowl of similar shape but larger circumference, emulating an "hourglass shape" in the resulting intertwine of computer-controlled micro-tunnels, with an aperture at the juncture between the mouth-up bowl and the mouth-down bowl, such that higher hydrostatic pressure in the bowl beneath will concentrate contaminates and contaminated groundwater of higher pressure below and channel them upward through such aperture, at rates which may be varied in accordance with adjustable variation in aperture size by chosen aperture perimeter, varied by operators decision through the use of chilled tunnels at varying distances from the center of the aperture involved. The aperture may be of a physical valve, or more advantageously be defined by the ice shield by controlling the cooling passages to allow for an permeable area 21.

Due to the application of Bernoulli's Principle, a greater or lesser level of artesian flow may be regulated in addition by variation of the circumference and thickness of the chill formed mouth-down bowl, in illustrative allegory being "the bottom half of the hourglass." This will thus allow the use of naturally occurring pressure phenomena, coupled with aperture variation bowl size modulation to both contain sunken contaminates and move them via such hydrostatic pressure differential up to the surface, while still, via the top and "mouth-up" bowl serving to contain such contaminants in order to increase the predictability of managing them. Thus use of controlled aperture shielding resulting from shaped frozen groundwater through the use of modem micro-tunneling technique coupled with inserted super-cooled fluids as a mechanism of establishing sustaining and modifying such shield may be undertaken.

Computer directed micro-tunneling technique may establish pathways for the introduction of super-cooled fluids, or intermediary cooled fluids, towards the establishment of an "ice basket," progressing to an "ice shield" or "ice bowl" beneath a contaminated site in order to mitigate migration from one side of the so-constructed bowl or shield to the other side of the same so-constructed emplacement, and such prior submitted Art, as referenced by the identification numbers thereupon as here stated are here used for the limited purpose of illustration, and the prior applications are not incorporated herein as though more fully set forth.

One embodiment differs in that it proposes not a shield like previously proposed, but instead here submit a Bernoulli-effect-based flow-rate adjustable shield and hydrostatic pump combination machine, of particular utility in situations where, for example changes in geomorphology have resulted in an aberration of prior groundwater migration patterns, including in situations such that there is a resulting net flow upward into the original contamination source area. Moreover, the present subject matter allows for the gradual dissipation of contaminated water, as well as control dilution of contaminated water.

Figure 3:
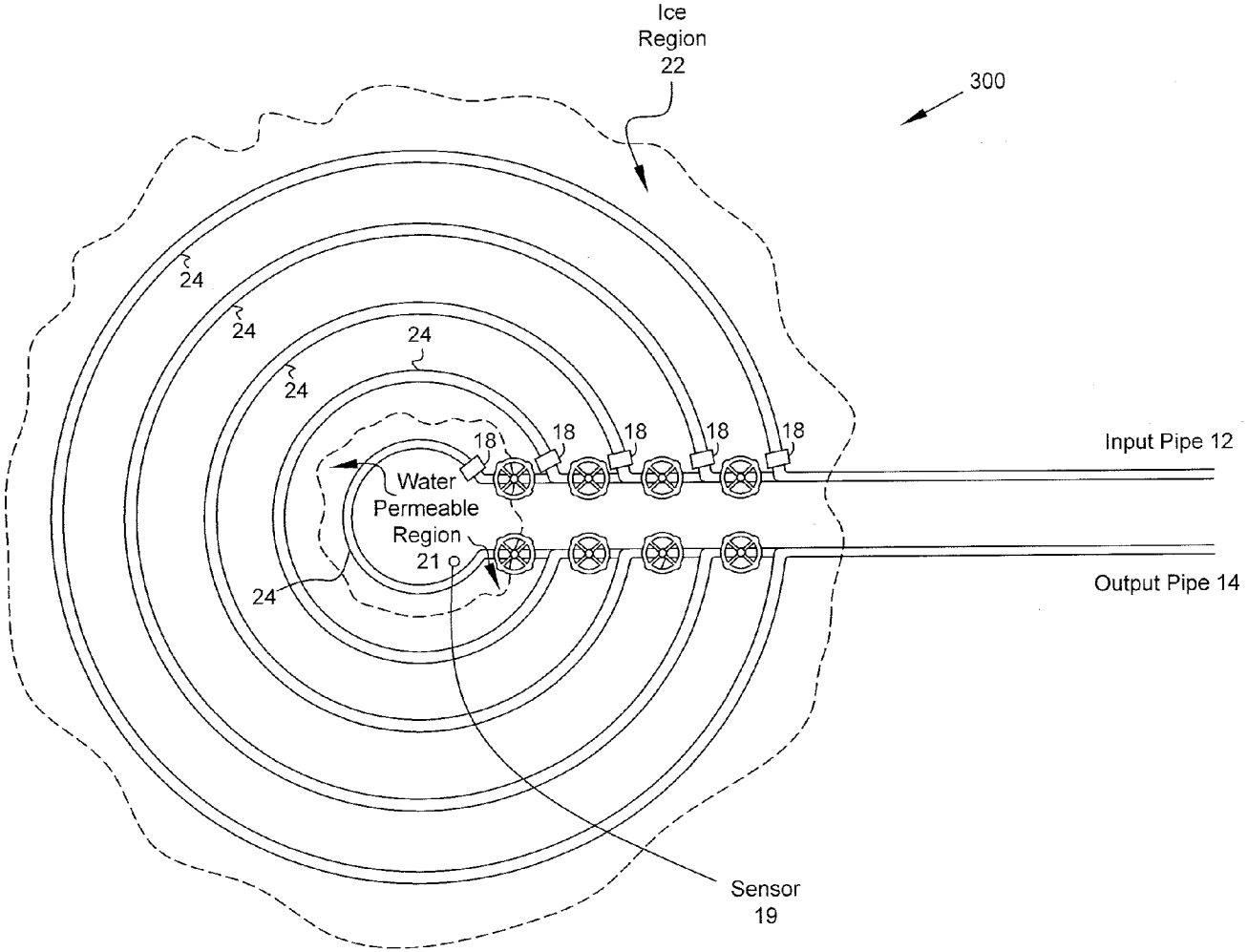
FIG. 3 is a top view of another embodiment of the present subject matter
Figure 4:
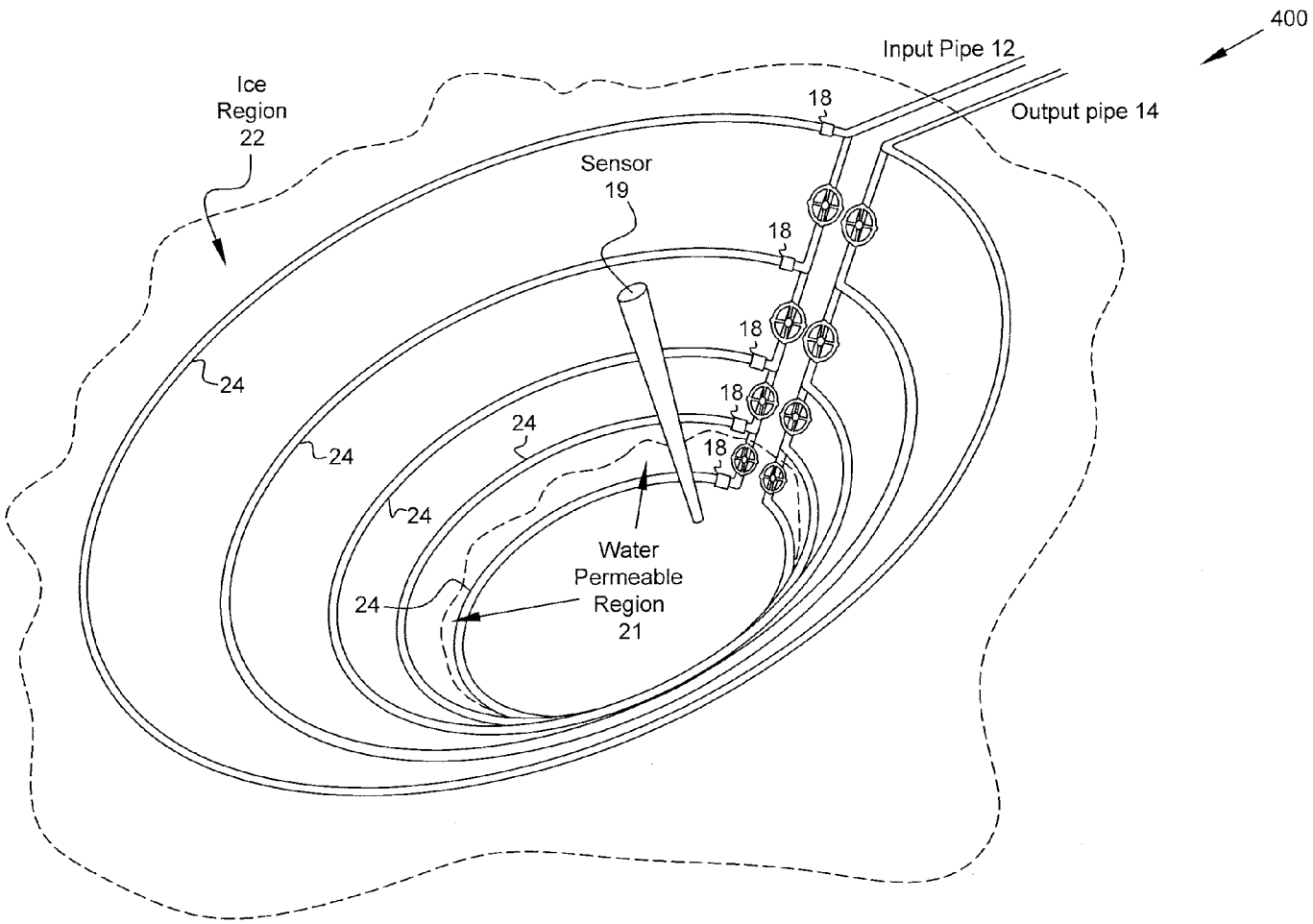
FIG. 4 is a isometric view of the embodiment of FIG. 3.

FIGS. 3 and 4 illustrate a system for creation of an ice region 22 (ice shield) having a variable water permeable region 21. As shown the cooling passages 24 for all but the inner most ring cause the ground water to freeze resulting in an ice region in which a water permeable region remains which may allow water to enter or leave the boundary of the ice shield 22. By selecting the cooling passages 24 to engage the size of the permeable region may be changed. For example if the inner passage 24 where activated the permeable region could be reduced to zero and effectively present any water to pass through the boundary. Similarly, if the inner two passages 24 would closed the permeable region 21 would increase. A sensor 19 is shown in the figures allowing the contaminate level to be determined within the ice shield 22 and also proximate the water permeable region 21 to aid in the control of the variable aperture 21. The sensor may also extend to outside the ice shield 22. Information regarding the relative contamination of water in/outside or passing through the aperture 21 may be used to control the aperture 21.

Figure 5:
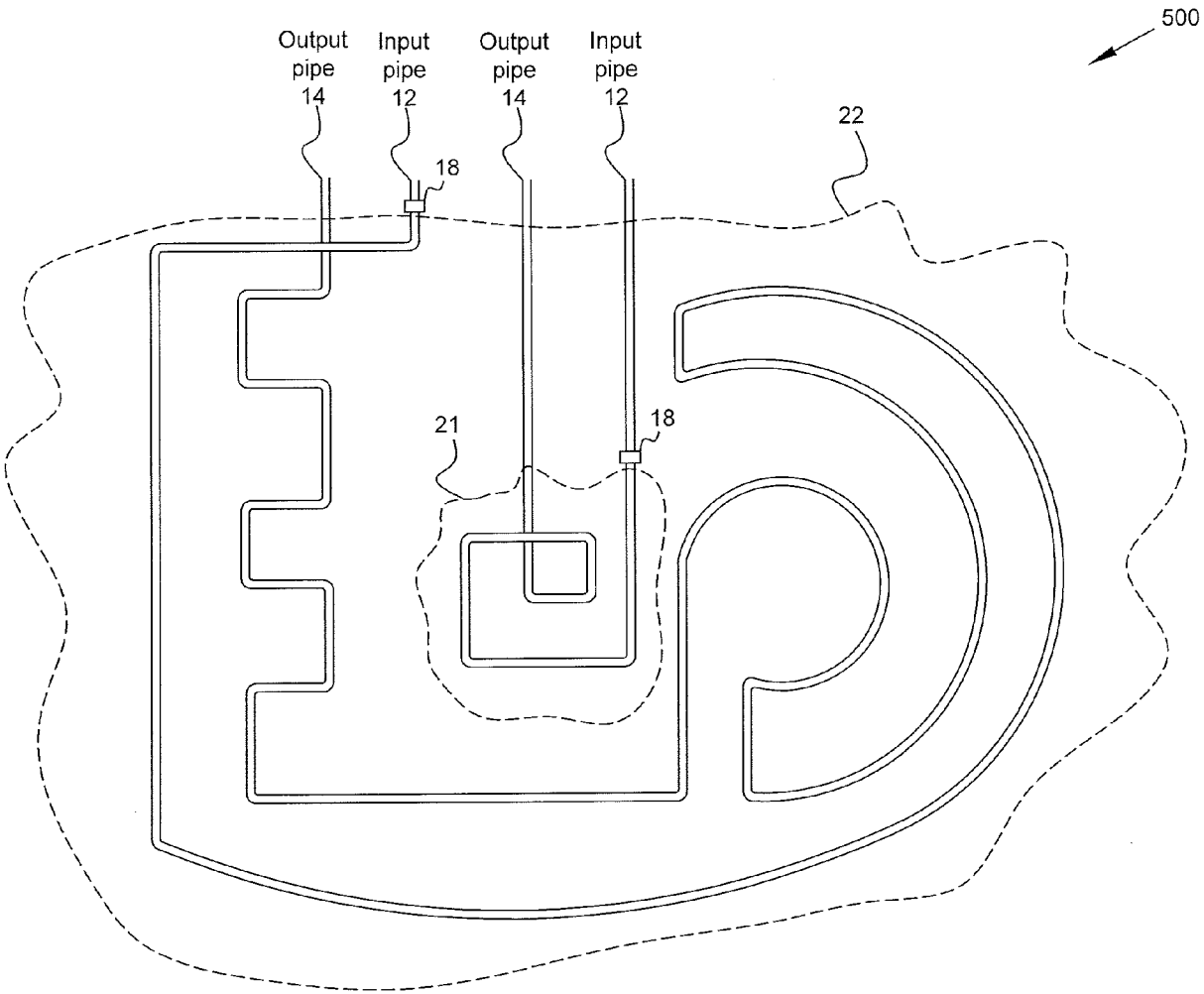
FIG. 5 is another arrangement to provide a variable water permeable region according to an embodiment of the present subject matter.
Figure 6:
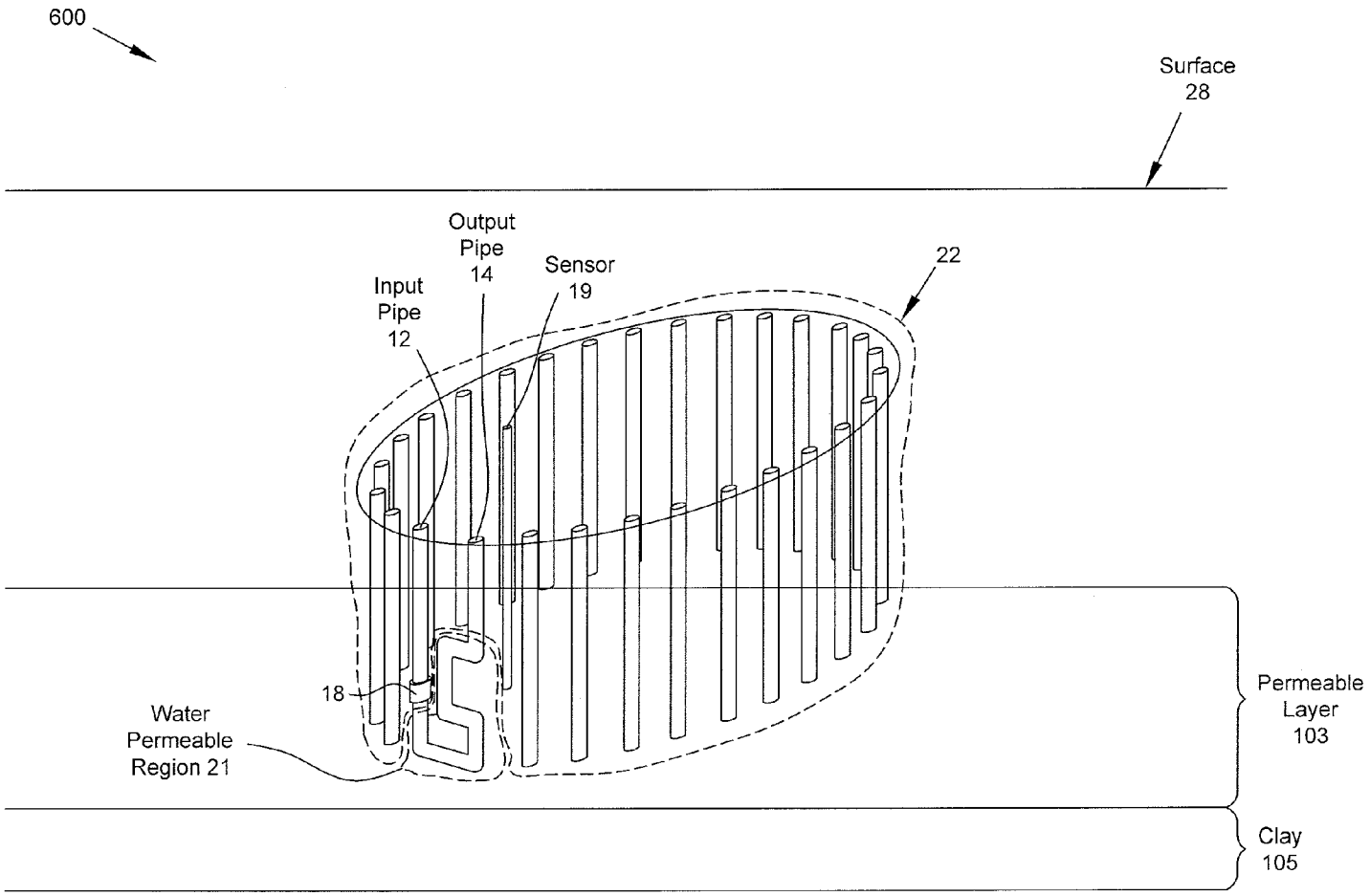
FIG. 6 is another arrangement to provide a controllable water permeable region on a non-permeable clay substrate according to an embodiment of the present subject matter.

FIGS. 5 and 6 illustrate various arrangements of the ice shields and the water permeable regions 21. In FIG. 5, a binary water permeable region 21 is shown. The application of cooling fluid or gas through the input pipe 12 closes the aperture 21, and ceasing to provide the cooling fluid opens the aperture 21. The cooling channels shown in FIG. 5 demonstrate the various patterns in which the channels may be constructed.

FIG. 6 shows the addition of a variable water permeable region 21 to a traditional ice shield 22, characterized by vertical wells with in the permeable layer 103 for the cooling of the ground water. In FIG. 6, the bottom of the containment shield is shown as Clay 105 and thus cooling passages are not required to bound the contaminated water. As in FIG. 5, the permeable region 21 is shown as a binary system, however a variable aperture as described above is also envisioned.

Figure 8A:
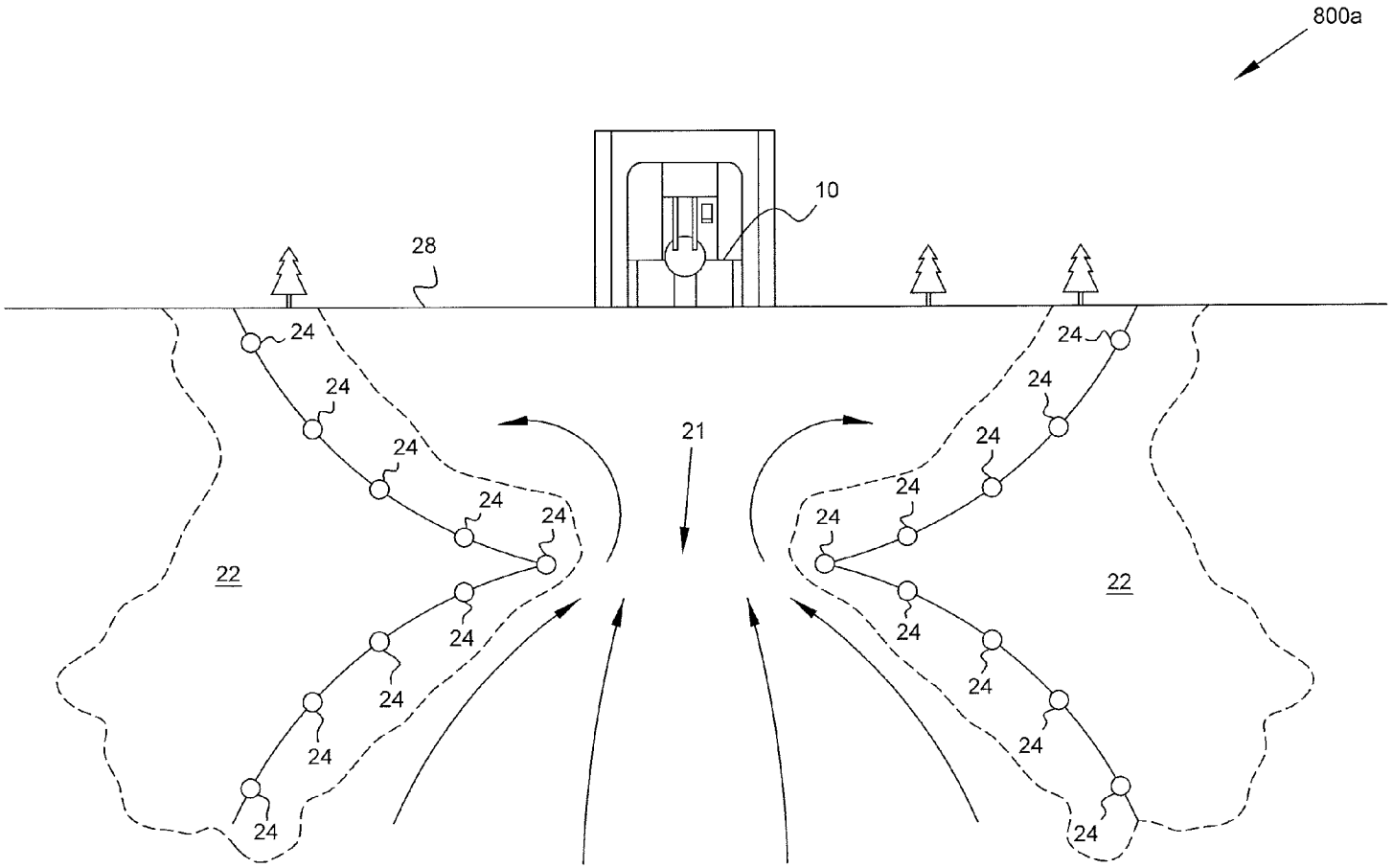
FIGS. 8A and 8B illustrate the control of ground water entering
Figure 8B:
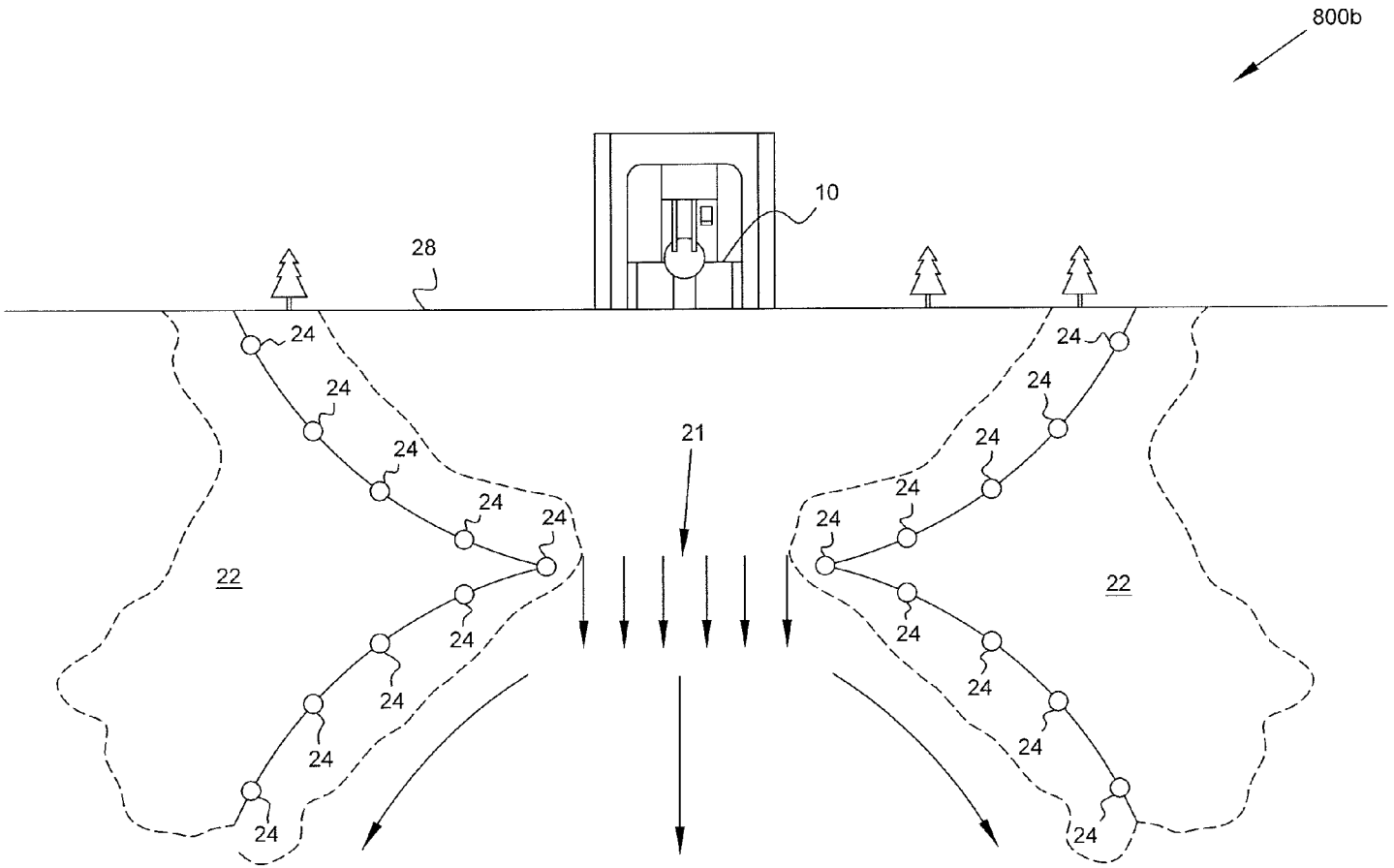

FIGS. 8A and 8B shows the present subject matter in which the ice shield 22 forms and internal hour glass shape. By selectively choosing the cooling channels 24 to activate the water permeable region 21 may be expanded or narrowed to control the flow of water into the ice shield 22 as shown in FIG. 8A or out of the ice shield 22 as shown in FIG. 8B. The release of contaminated water through the variable aperture 21 may be a function of the contamination determined by the sensor 19. The contaminated water may be slowly released over time at safe level. Alternatively, the contaminated water can be diluted by allowing ground water up through the variable aperture 21 over time. The aperture may also be cycled, allowing water in during the dry season, and water out during the wet seasons, or vice versa to slowly dilute and disperse the contaminates.

The variable aperture 21 may also serve as a safety value, in that an influx of surface water via rain or snow may result in an overflow of the ice shield 22 which would immediately effect the biosphere with contaminated water, whereas if the overflow was released from the aperture some natural filtering, dilution and filtering would likely mitigate the resultant contamination compared with a surface release.

Figure 7:
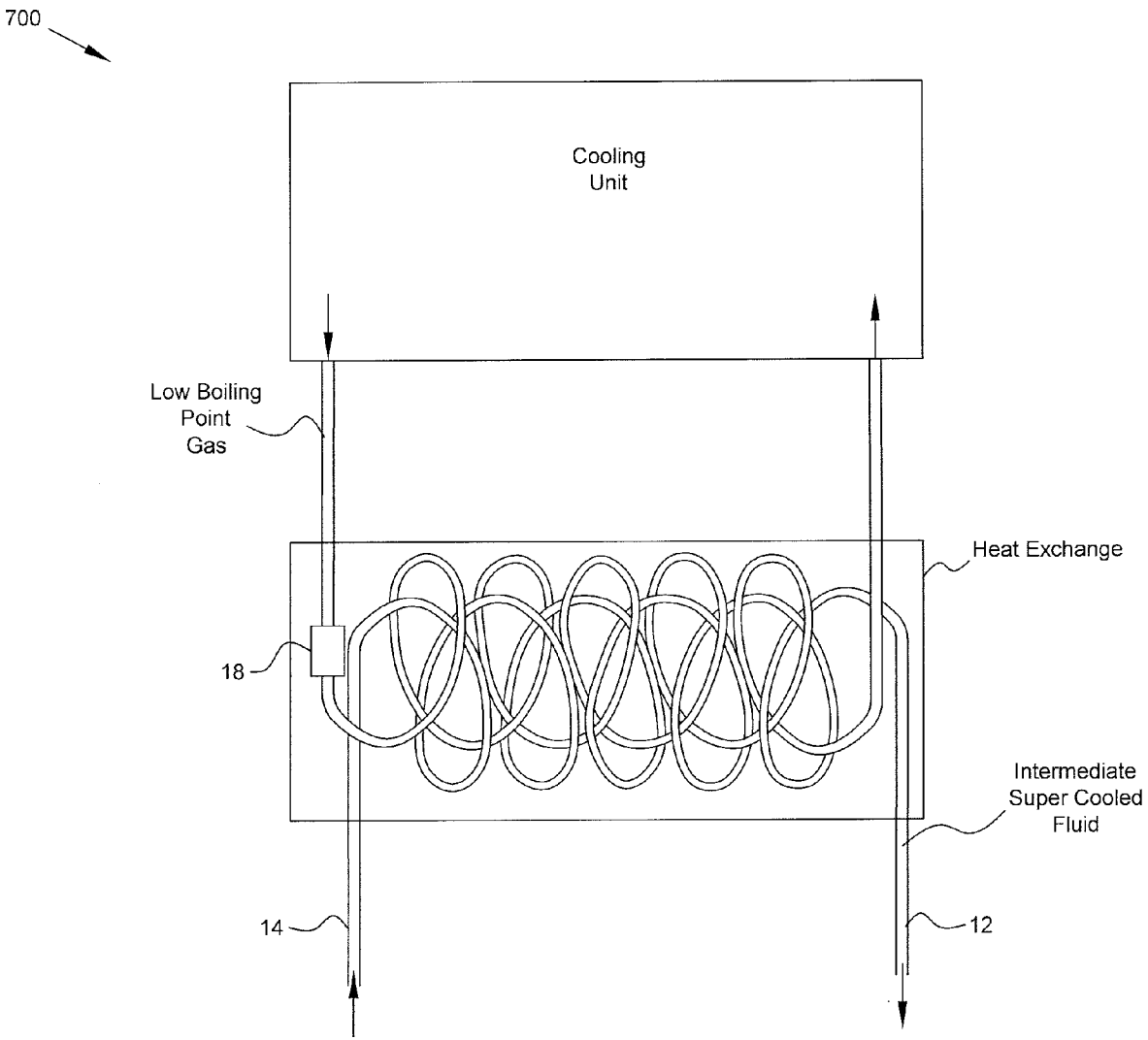
FIG. 7 illustrates a heat exchanger used with an intermediate fluid according to an embodiment of the present subject matter.

While the cooling fluid and pipe placement has been primarily described using expanding gas as the working fluid, the use of an cooled intermediate fluid as described above is equally envisioned. A heat exchanger not shown cools the intermediate fluid which enters into inlet 12 and exits from outlet 14. With the use of an intermediate fluid the apertures 18 would not be needed to expand the working gas and the portions of the passages outside of the desired freezing zone would advantageously be insulated to prevent heat absorption. FIG. 7 illustrates the use of a heat exchanger for providing the supper cooled intermediate fluid. The intermediate fluid enters from outlet 14 passes through the coils of the heat exchanger where it is cooled an exits as a super cooled fluid to inlet 12. The cooling unit provides the working fluid typically low boiling point fluid and expands it through the aperture 18 which absorbs heat from the intermediate fluid and then returns to the compressor of the cooling unit which removes the absorbed heat. The general construction of heat exchangers is well known and thus will not be further described.

For the use and the resulting tunnels from lateral or horizontal or mixed angle drilling, and the installation of piping in the resulting tunnels, through the use of modem micro-tunneling technique, including but not limited to remote controlled micro-boring machinery (MTBM) for the establishment of radii channels underneath a toxic site or a site with potential for toxicity, including as illustrated in FIG. 1 where cooling of the earth and water within it results from the circulation of a super-cooled liquid within pipes installed in the resulting channels, including but not limited to channels drilled in overlapping radii form, such that a "shallow ice bowl" effect results, such that the migration of contaminated groundwater beyond such ice bowl is mitigated and where the cooling fluid used within such shallow radii channels includes intermediary fluids (as opposed to super low boiling point fluids as may be used to obtain the cooling of such intermediary fluids) including but not limited to saline solutions with resulting lowered freezing points.

The shallow angle frozen ice barrier, including in radii shape, and including in shapes as shown in FIG. 1, where cooling of the earth and water within has resulting in the establishment of such frozen ice barrier, from the circulation of a super cooled intermediary liquid within pipes installed in the resulting channels, including but not limited to intermediary fluids such as saline solutions which have a low freezing point.

Regarding the insertion of pipes for the circulation of super-cooled fluids, including fluids with very low boiling points, and also including intermediary fluids with very low freezing points, the use of pipes which are composed of corrosion resistant metals or plastics or other corrosion resistant materials, but that such pipe is in turn enclosed within an exterior pipe or casing, with spacers keeping a constancy of distance between the exterior of the interior pipe and the interior of the exterior casing, and that the intervening space between the interior side of the exterior casing and the exterior side of the interior pipe is filled with lead or other radiation migration impairing materials, such that the contamination is avoided of the super-cooled fluid or gas used for cooling purposes as shown herein and in FIG. 1 where cooling of the earth and water within it results from the circulation of a super-cooled liquid within pipes installed in the resulting channels.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

I claim:

1. A containment system for controlling the migration of fluid from a contaminate source comprising:

a containment grid comprising a plurality of cooling channels, said grid defining a plurality of regions between adjacent cooling channels;

an aggregate comprising frozen water and soil, said aggregate in thermal communication with the plurality of cooling channels and occupying the regions between adjacent cooling channels;

wherein said containment grid is adapted to form a partial envelope around the contaminate source beneath the ground surface;

a variable water permeable region in the containment grid; and a sensor for determining contamination;

wherein the plurality of cooling channels form an hour glass shape, the hour glass shape defined by concentric circles with increasing diameters and increasing height above the variable water permeable region and concentric circles with increasing diameters and increasing vertical distance below the variable water permeable region.

2. The containment system of claim 1, further comprising:

a plurality of valves on the respective cooling channels;

said plurality of valves are operable to control the flow of cooling media in the respective cooling channels;

wherein the area of the variable water permeable region is a function of operation of the valves.

* * * * *